United States Patent [19]

Caknis

[11] 4,178,840

[45] Dec. 18, 1979

[54] AIR DISCHARGE TERMINAL UNIT

[76] Inventor: Nicholas Caknis, c/o P.O. Box 4035, Pretoria 0001, South Africa

[21] Appl. No.: 885,113

[22] Filed: Mar. 10, 1978

[30] Foreign Application Priority Data

Mar. 11, 1977 [ZA] South Africa ..... 77/1500

[51] Int. Cl.[2] ..... F24F 13/06

[52] U.S. Cl. ..... 98/38 E; 98/40 D; 236/13

[58] Field of Search ..... 98/40 D, 38 E, 38 F, 98/38 R; 236/13, 49

[56] References Cited

U.S. PATENT DOCUMENTS 4,090,434 5/1978 Krisko et al. ..... 98/38 E

*Primary Examiner*—William E. Wayner

*Attorney, Agent, or Firm*—Young & Thompson

[57] ABSTRACT

An air discharge terminal unit comprises a plenum housing having a main air inlet, a main air outlet and an induced air inlet, the induced air inlet being located unilaterally along the flow path of the air between the main air inlet and the main air outlet to control the flow of air from the main air oulet.

2 Claims, 6 Drawing Figures

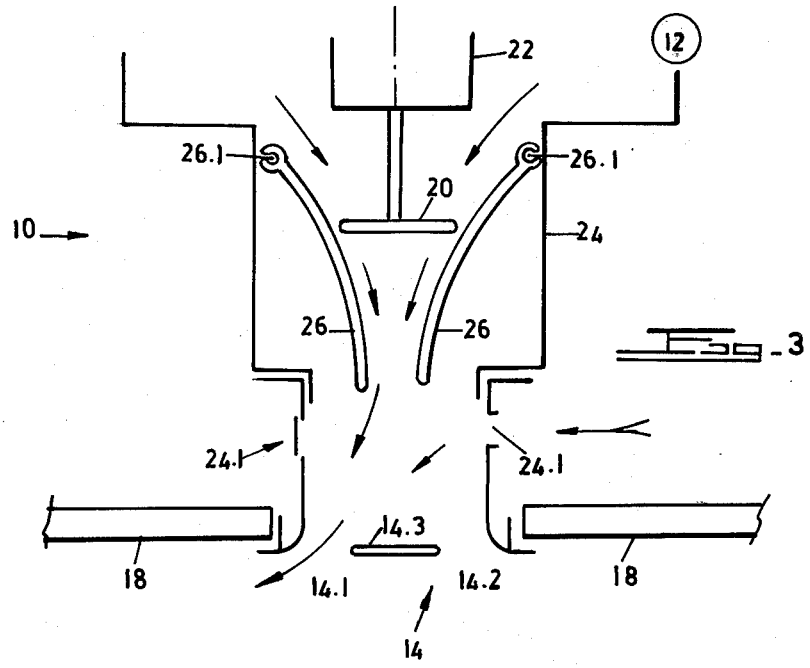
12
22
26.1
26.1
20
10
24
26
26
3
24.1
24.1
14.3
18
14.1
14.2
18
14
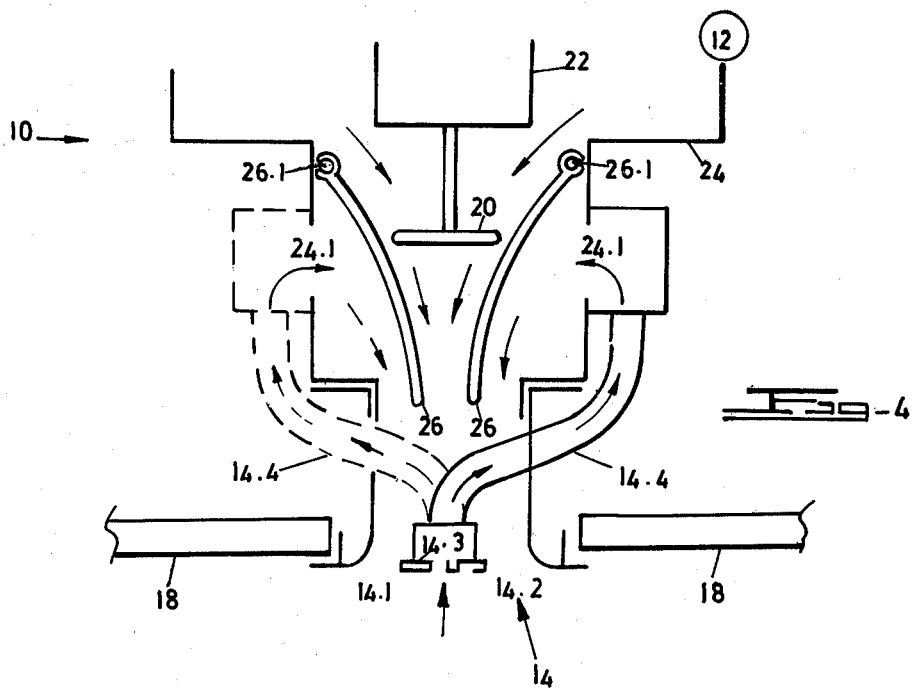
12
22
10
26.1
26.1
24
20
24.1
24.1
26
26
4
14.4
14.4
14.3
18
14.1
14.2
18
14

AIR DISCHARGE TERMINAL UNIT

This invention relates to improvements in or relating to air conditioning. More particularly, the invention relates to an air discharge terminal unit or air diffuser suitable for use in an air conditioning system.

According to the invention there is provided an air discharge terminal unit comprising a plenum having a main air inlet, an induced air inlet, a first air outlet and a second air outlet spaced from the first air outlet in a direction away from the induced air inlet, the induced air inlet being located unilaterally along the flow path of the main air stream between the main air inlet and the air outlets, means for selectively controlling the inflow of induced air through the induced air inlet between a condition of minimum inflow of induced air whereby the outflow of the main air stream through the outlets is substantially unaffected and air flows through both air outlets in substantially equal proportions and a condition of maximum inflow of induced whereby the main air stream is deflected away from the induced air opening to flow through the one air outlet only.

The air discharge terminal unit may include a temperature sensitive device for controlling the operation of the means for controlling the inflow of induced air.

When minimum heat load conditions prevail in the air conditioned space, the unit will tend to discharge air in one direction only. However, when conditions other than minimum heat load conditions prevail in the air conditioned space, the unit will tend to discharge air in two directions. During minimum heat load conditions, and when the unit is called upon to supply less than the fixed minimum air quantity, the unit tends to supply hot air which sweeps a room window or external wall facade and thereby accomplishes heating of the space, or the room.

The unit may include modulating control vanes which control the air supply discharge of linear air conditioning diffusers or which operate with an expanding and contracting diaphragm or bladder valve which similarly control the air supply discharge from the diffuser.

When high velocity supply air passes between the modulating control vanes, zones of negative air pressure are created in the spaces adjacent to the control vanes. This induces air to flow from the surrounding area through the induced air inlet to the negative air pressure zone.

Since the flow of induced air is uni-directional, it causes the main air supply stream to deflect and hence air discharge takes place in one direction only.

When the modulating vanes open to present an increased discharge area, the velocity of the discharged air decreases. This decrease in the main air discharge velocity causes an increase in pressure in the negative pressure zones adjacent the modulating control vanes. Hence, the flow of induced air through the induced air intake is diminished and deflection of the main air supply does not take place. Thereby air is discharged in two directions.

The unit may include a thermostat operatively connected to an air flow regulating means. The thermostat may comprise a bi-metallic element which is operatively connected to the air flow regulating means.

In use, a small quantity of return air from the air conditioned space may be caused to flow over the thermostat for sensing the temperature to control the operation of the unit. For this purpose, the bi-metallic element on the thermostat may be located in the path of the induced air-stream.

In an alternative embodiment, the thermostat may be located in the air conditioned space itself.

The invention will now be described, by way of example, with reference to the accompanying schematic drawings, in which:

FIG. 3 is a side sectional view of another embodiment of the invention showing an alternative location of induced air intakes;

FIG. 4 shows a side sectional view of yet another embodiment of the invention showing induced air entry from an air conditioned space itself;

Like reference numerals refer to like parts, unless otherwise indicated.

Figure 1:
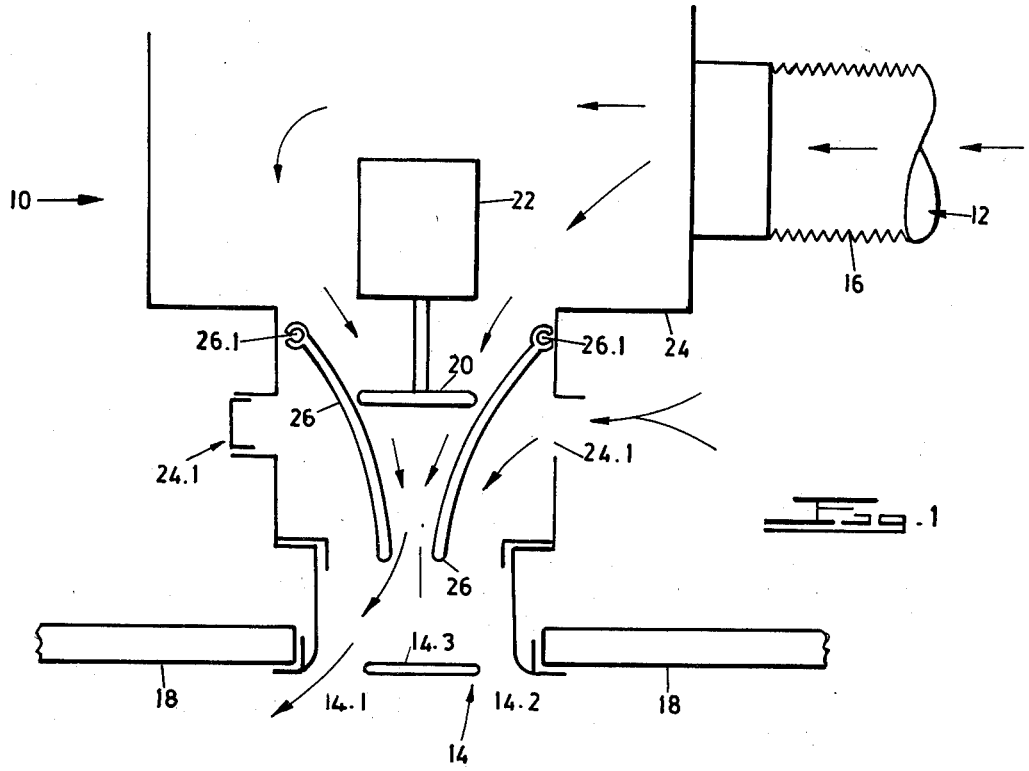
FIG. 1 is a side sectional view of an air discharge terminal unit showing the various components in an operative condition corresponding to a minimum air supply volume.

Referring generally to the drawings, reference numeral 10 generally indicates an air discharge terminal unit comprising an air inlet 12 and an outlet 14 for the discharge of air, the flow whereof is indicated by unnumbered arrows. Air is supplied via a flexible supply pipe 16 from a main air supply (not shown).

The air discharge terminal unit 10 is mounted in a ceiling void of an office, room, or the like. Reference numeral 18 denotes a ceiling panel of the office, room, or the like, through which air is supplied to the interior of the office, room, or the like, as shown by the direction of the arrows.

The amount of air entering the office, room or the like, can be varied by means of a movable cam 20 actuated by a pneumatic actuator 22 which is in turn controlled by a pneumatic thermostat, or other suitable sensing device (not shown), located within the air conditioned space.

The flow path of the air is defined by means of a plenum 24.

Modulating control vanes 26 are hinged at their one extremity 26.1 to at least partly obstruct the flow path of the air flowing through the unit 10. Conveniently, the vanes 26 may be biased to hingedly swing toward each other. An opening 24.1 is provided in the plenum outwardly of the vanes 26. In use, one or the other of these openings will be open whilst the other opening is blocked off as shown in the drawings.

The air discharge opening 14 comprises two discharge opening slots namely 14.1 and 14.2 separated by a suitable plate 14.3.

With particular reference to FIG. 4, the plate 14.3 has an opening therein connected by means of pipes 14.4 to the openings 24.1 in the plenum.

The unit 10 operates as follows:

Air enters the unit 10 from the main air supply at the air inlet 12 via the flexible supply pipe 16.

Referring specifically to FIGS. 1, 3 and 4, the modulating air control vanes are in a minimum air supply discharge position. High velocity supply air which passes between the modulating air control vanes 26 creates zones of negative air pressure in the spaces adjacent to the control vanes and outboard thereof.

This causes induced air to flow from the ceiling void via the induced air intake opening 24.1 toward the negative air pressure zone. The induced air causes the main air supply stream to deflect (toward the left in FIGS. 1, 3 and 4) and air discharge takes place in one direction only namely through the discharge opening 14.1 of the discharge opening 14 (i.e. towards the left in the drawings).

If desired, the air discharge can be arranged to flow in the opposite direction i.e. through th discharge opening 14.2 of the discharge opening 14 only, by blanking off the right-hand (open) induced air intake and opening the left-hand induced air intake.

With particular reference to FIG. 4, induced air enters the port 24.1 through the pipe 14.1 and through the opening in the plate 14.3. Induced air in this case is taken from the air conditioned space and not from the false ceiling void as shown in FIG. 2.

Figure 5:
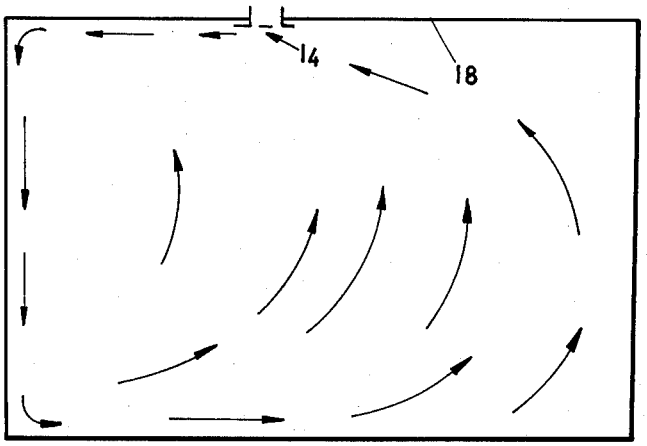
FIG. 5 is a diagrammatic side view of flow of air in an air conditioned space from an air discharge terminal unit as shown in FIGS. 1, 3 or 4.

FIG. 5 shows the air flow pattern for the unit 10 operating in the condition shown in FIGS. 1, 3 and 4.

Figure 2:
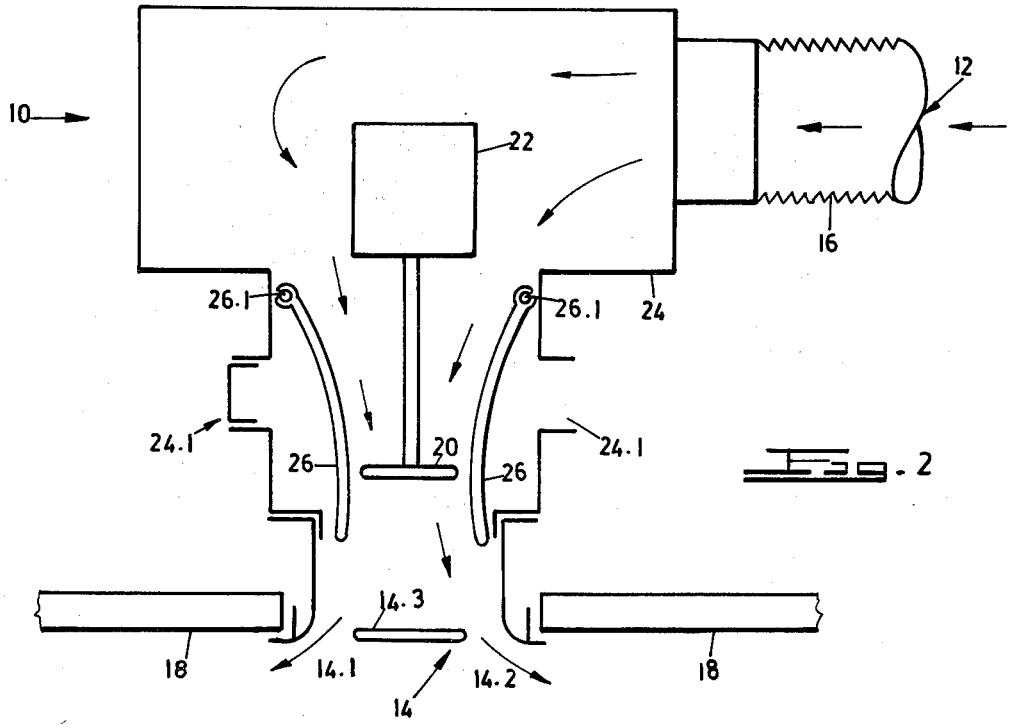
FIG. 2 is a side sectional view of the air discharge terminal unit of FIG. 1 showing the components in an operative condition corresponding to a maximum air supply volume.

Referring now particularly to FIG. 2 the modulating air control vanes 26 are in a maximum supply air discharge position, as varied by means of the cam 20 which is controlled by the pneumatic actuator 22. The modulating air control vanes 26 have been moved to an open condition on demand for cooling which is sensed by the air conditioned space thermostat (not shown) which causes the pneumatic actuator 22 to move the cam 20 in a vertically downward direction, thereby opening the moudlating vanes 26.

When the modulating vanes 26 commence opening relative to the position shown in FIGS. 1 and 3, the main air discharge cross-sectional area is increased which results in a decrease in velocity of the discharged air. The decrease in the air discharge velocity causes the pressure between the relevant air control vanes and the induced air intake opening 24.1 to gradually increase so that the flow of induced air through the air intake opening 24.1 decreases, and hence the direction of air flow is unaffected or relatively unaffected, and the unit 10 then discharges air in two directions through the discharge opening 14, namely through the discharge openings 14.1 and 14.2.

Figure 6:
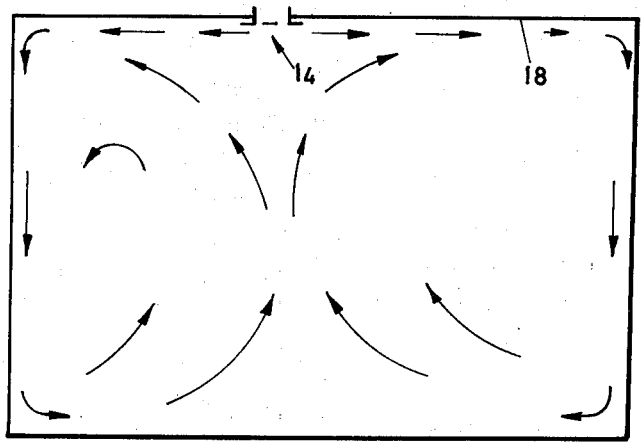
FIG. 6 is a diagrammatic side sectional view of air flow in an air conditioned space from an air discharge terminal unit as shown in FIG. 2.

FIG. 6 shows a typical air flow pattern for an air diffuser unit operating according to the unit shown in FIG. 2.

FIG. 5 shows a typical air flow pattern within an air conditioned space during the cycles at minimum air discharge conditions. The air stream sweeps the glass facade or external wall area of the room, and is typical for the air discharge cycle when heating is required.

FIG. 6 shows a typical air flow pattern within an air conditioned space during cycles of maximum air discharge conditions. It can be seen how the cold air stream sweeps the glass facade or external walls of the room to reduce heat loads due to solar and transmission heat gains. This air flow pattern is typical for the air discharge when cooling is required.

Advantages of the invention include minimum air supply in a direction where it is required during the heating cycle. This results in energy savings because the condition of both heating and cooling functions cannot take place simultaneously.

The function of the unit 10 to produce a uni-directional or bi-directional air discharge is accomplished automatically without the use of any further mechanical moving parts which results in a substantially maintenance free unit.

The invention can be applied to any conventional variable volume linear air diffuser which incorporates control air vanes consisting of either moving blades, or expanding or contracting diaphragms, or the like.

The cost of applying the invention to linear diffuser systems is minimal, and should not substantially increase the cost of conventional linear air diffusers.

What I claim is:

1. An air discharge terminal unit comprising a plenum having a main air inlet, an induced air inlet, a first air outlet and a second air outlet, spaced from the first air outlet in a direction away from the induced air inlet, the induced air inlet being located unilaterally along the flow path of a main air stream which flows between the main air inlet and the air outlets, a pair of modulating control vanes located along the flow path of the main air stream on opposite sides thereof, one of said vanes being disposed between said flow path and said induced air inlet, and means for simultaneously moving said vanes toward and away from each other thereby respectively to restrict said main air inlet and expand said main air inlet and respectively to move said one vane away from and toward said induced air opening thereby respectively to expose and to mask said induced air opening.

2. An air discharge terminal unit according to claim 1, and a second induced air inlet on the side of the other said vane opposite said main air stream, and means for selectively separately opening and closing one of said induced air inlets.

* * * * *